US009186779B2

(12) United States Patent
Peled et al.

(10) Patent No.: US 9,186,779 B2
(45) Date of Patent: Nov. 17, 2015

(54) SELF-ADJUSTABLE WRENCH

(71) Applicants: Avishar Yona Peled, Hararit (IL); Ahava Ilana Peled, Hararit (IL)

(72) Inventors: Avishar Yona Peled, Hararit (IL); Ahava Ilana Peled, Hararit (IL)

( * ) Notice: Subject to any disclaimer, the term of this patent is extended or adjusted under 35 U.S.C. 154(b) by 426 days.

(21) Appl. No.: 13/842,431

(22) Filed: Mar. 15, 2013

(65) Prior Publication Data

US 2014/0260827 A1 Sep. 18, 2014

(51) Int. Cl.

| | |
|---|---|
| ***B25B 13/18*** | (2006.01) |
| ***B25B 13/12*** | (2006.01) |
| ***B25B 13/22*** | (2006.01) |
| ***B25B 13/24*** | (2006.01) |
| *B25B 7/12* | (2006.01) |

(52) U.S. Cl.

CPC ..... *B25B 13/18* (2013.01); *B25B 13/22* (2013.01); *B25B 13/24* (2013.01); *B25B 7/12* (2013.01)

(58) Field of Classification Search

CPC ..... B25B 13/18; B25B 13/22; B25B 13/24; B25B 7/12

USPC ..... 81/126, 128, 134, 136–140

See application file for complete search history.

(56) References Cited

U.S. PATENT DOCUMENTS

| | | | | |
|---|---|---|---|---|
| 1,500,312 | A * | 7/1924 | Hacheney | 81/154 |
| 1,758,664 | A * | 5/1930 | Hoelper | 81/356 |
| 3,232,150 | A * | 2/1966 | Ailegraud | 81/143 |
| 4,214,491 | A * | 7/1980 | Martinmaas | 81/134 |
| 4,572,037 | A * | 2/1986 | Jenq-Shyong | 81/126 |
| 8,549,961 | B2 * | 10/2013 | Huang | 81/165 |
| 8,726,768 | B2 * | 5/2014 | Mitchell | 81/165 |
| 2013/0319187 | A1 * | 12/2013 | Hsu | 81/126 |

* cited by examiner

*Primary Examiner* — Bryan R Muller

(74) *Attorney, Agent, or Firm* — Blue Filament Law PLLC; Guy Levi

(57) ABSTRACT

The disclosure is directed to a self-adjusting wrench, comprising a movable jaw member, a fixed jaw member a biasing member and a handle, wherein the movable jaw member, the fixed jaw member and the handle engage to self-adjust and lock the gap between the movable jaw and the fixed jaw upon applying pressure to the jaws using the handle.

20 Claims, 4 Drawing Sheets

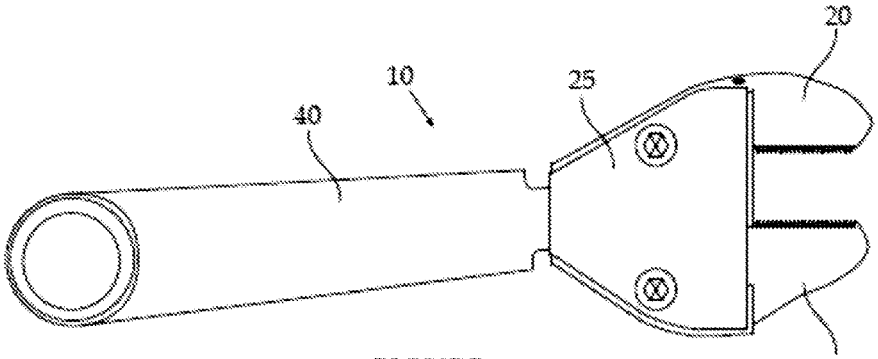
FIGURE 1
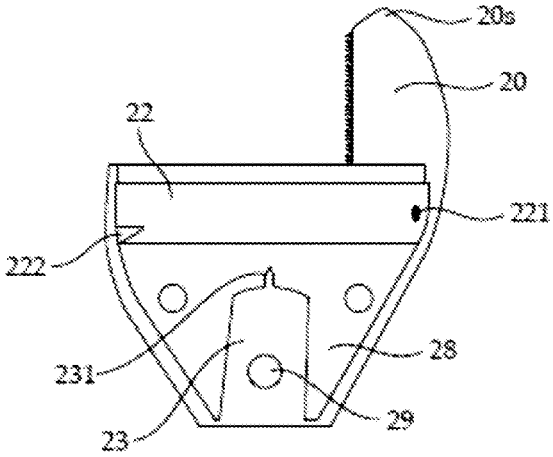
FIGURE 2A
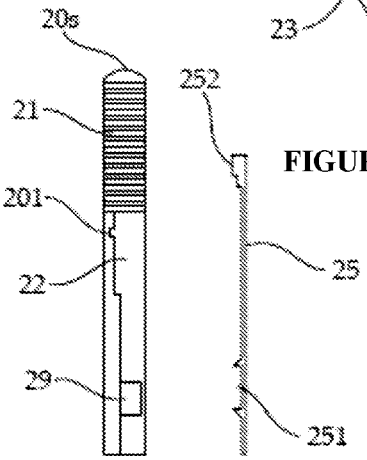
FIGURE 2B
FIGURE 3A
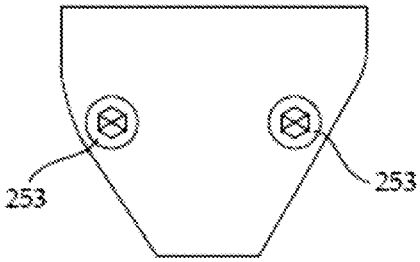
FIGURE 3B

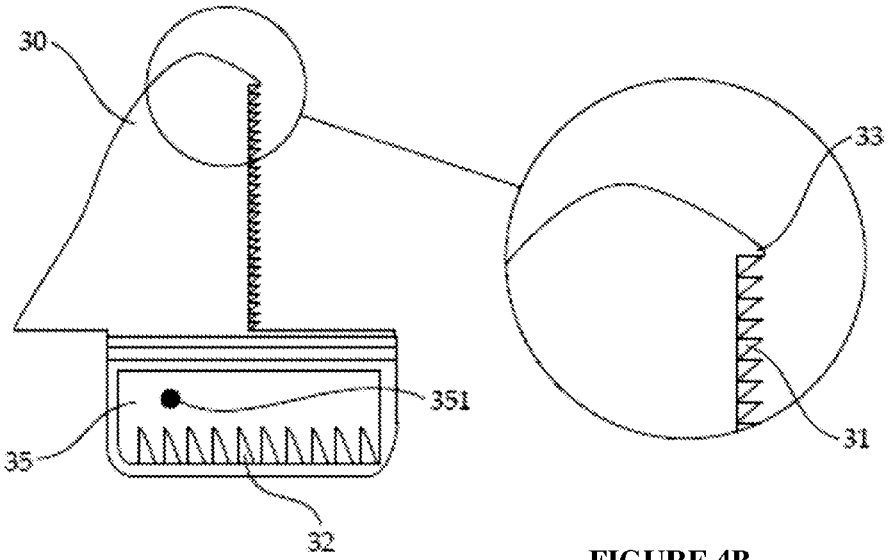
FIGURE 4A
FIGURE 4B
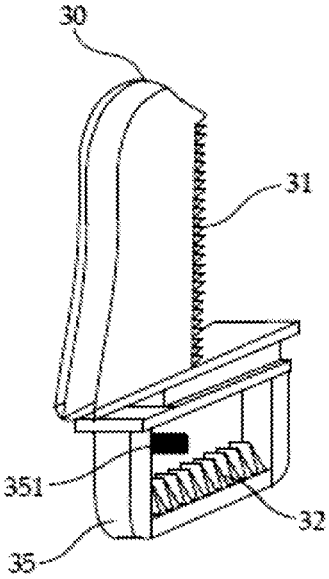
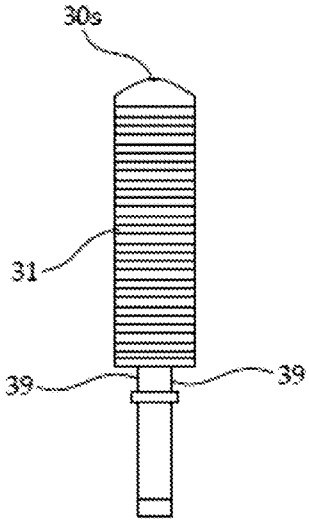
FIGURE 4C
FIGURE 4D

SELF-ADJUSTABLE WRENCH

BACKGROUND

The disclosure is directed to an adjustable key wrench. Specifically, the disclosure is directed to a self-adjusting key wrench.

Conventional adjustable wrenches typically comprise a movable jaw and a stationary jaw extending from a handle portion. A worm gear receiving portion is provided at a lower portion of the movable body. A square hole is disposed in the fixed jaw to receive a section of the worm gear receiving portion of the movable jaw. A worm gear is provided within the square hole to engage the worm gear receiving portion of the movable jaw. When a user manually rotates the worm gear, the movable jaw can move in a horizontal direction corresponding to the rotation of the worm gear, which in turn drives the movable jaw to move in the same direction, thereby adjusting the width of a jaw of the wrench.

Adjustable wrenches having that configuration are relatively simple in construction and convenient for use. However, such a wrench has disadvantages that when the width required to be adjusted is relatively large, the worm gear must be turned frequently. For example, if a large size wrench is used in exploitation of oil where a relatively larger pipe or nut needs to be turned, it is necessary to turn the worm repeatedly to give a full jaw travel. Furthermore, it is difficult to reliably hold an object by manually adjusting the width of the jaw. Also, adjusting the gap may become cumbersome when the variability of the widths needed to be adjusted is large and frequent.

Accordingly, there is a need for a fast, self-adjusting wrench, capable of adjusting to the width of the nut with one hand, while maintaining the width for the duration of the operation of the wrench.

SUMMARY

In an embodiment, provided is a self-adjusting wrench comprising a fixed jaw having a distal end extending from a wrench housing, the housing defines a channel configured to receive a handle, a chamber configured to receive a portion of a movable jaw, an immobilizing boss, a biasing member boss, and a biasing member tab; a movable jaw having a distal end and a proximal end, the proximal end slidably operably coupled to the fixed jaw housing; an elongated handle operably coupled to the wrench housing, the handle having a proximal end and a distal end, and is capable of sliding toward and away from the fixed jaw, wherein the handle's distal end comprises an anterior wedge and an opposite posterior wedge; a two-dimensional biasing member, operably coupled to the distal end of the movable jaw, the wrench housing and the distal end of the handle, capable of simultaneously biasing the movable jaw toward the fixed jaw and the handle away from the fixed jaw; and a housing cover, wherein the proximal end of the movable jaw is configured to engage the distal end of the handle and lock the gap between the fixed jaw and movable jaw.

In another embodiment, provided herein is a method of turning a threaded rotating member, comprising: pressing a self-adjusting wrench against the rotating member, the self-adjusting wrench comprising a fixed jaw having a distal end extending from a wrench housing, the housing defines a channel configured to receive a handle, a chamber configured to receive a portion of a movable jaw, an immobilizing boss, a biasing member boss, and a biasing member tab; a movable jaw having a distal end and a proximal end, the proximal end slidably operably coupled to the fixed jaw housing; an elongated handle operably coupled to the wrench housing, the handle having a proximal end and a distal end, and is capable of sliding toward and away from the fixed jaw, wherein the handle's distal end comprises an anterior wedge and an opposite posterior wedge; a two-dimensional biasing member, operably coupled to the distal end of the movable jaw, the wrench housing and the distal end of the handle, capable of simultaneously biasing the movable jaw toward the fixed jaw and the handle away from the fixed jaw; and a housing cover, wherein the proximal end of the movable jaw is configured to engage the distal end of the handle and lock the gap between the fixed jaw and movable jaw; adjusting the gap between the fixed jaw and the movable jaw member; and applying torque effective to rotate the member.

BRIEF DESCRIPTION OF THE DRAWINGS

The features of the self-adjusting wrench described will become apparent from the following detailed description when read in conjunction with the drawings, which are exemplary, not limiting, and wherein like elements are numbered alike in several figures and in which:

FIG. 1, shows an embodiment of the self-adjusting wrench as assembled;

FIG. 2, shows front view (FIG. 2A), and a side view (FIG. 2B), of the fixed jaw member of an embodiment of the self-adjusting wrench;

FIG. 3, shows a side view (FIG. 3A) and front view (FIG. 3B) of the cover of the wrench housing of the fixed jaw member of an embodiment of the self-adjusting wrench;

FIG. 4, shows a front view (FIG. 4A) with an enlarged detail (FIG. 4B), a front isometric perspective (FIG. 4C) and a side view (FIG. 4D), of the movable jaw member of an embodiment of the self-adjusting wrench;

Figure 5A:
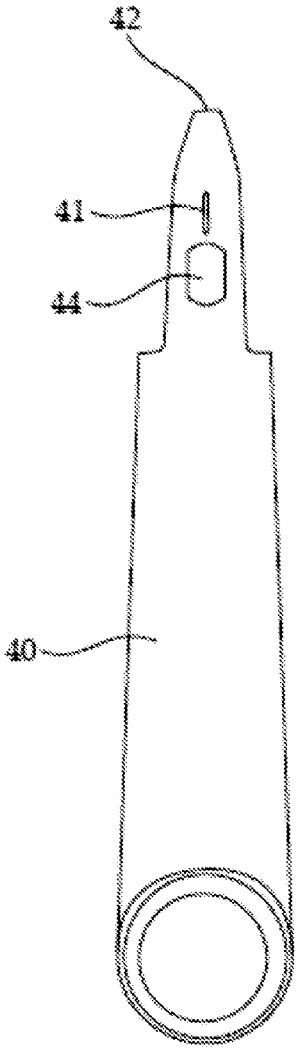
FIG. 5, shows a front view (FIG. 5A) and a side view (FIG. 5B) of the handle of an embodiment of the self-adjusting wrench.

While the disclosure is amenable to various modifications and alternative forms, specifics thereof have been shown by way of example in the drawings and will be further described in detail hereinbelow. It should be understood, however, that the intention is not to limit the disclosure to the particular embodiments described. On the contrary, the intention is to cover all modifications, equivalents, and alternatives.

DETAILED DESCRIPTION

The disclosure relates in one embodiment to adjustable key wrenches. In another embodiment, the disclosure relates to self-adjusting key wrenches. The term "self-adjusting" as used herein, refers to any adjustable wrench that includes parts therein that are capable of automatically adjusting the gap between the fixed jaw and the movable jaw when stress is placed on the handle part pushed against an object capable of being received between the movable jaw and the fixed jaw, and is able to lock and maintain the gap once the stress is removed. Absent such object, applying stress to the handle against the movable jaw, returns the gap to a zero distance condition. Accordingly, the term "self-adjusting" may also means that the wrench can be moved automatically from an open position to a closed position when a specific member is actuated.

The disclosure provides an self-adjusting wrench comprising: a wrench body provided with a first jaw at one end (in other words, a fixed jaw member); a second jaw member, slidably moveable relative to the first jaw; a handle coupled to the wrench body and the movable jaw member to lock the motion of the movable jaw member relative to the fixed jaw member; and, a biasing mechanism having a free state in which the movable jaw is able to move relative to the fixed jaw, and a locked state in which movement of the jaws relative to each other is prohibited, the biasing mechanism changing from the free state to the locked state after an object is pushed between the jaws.

Accordingly, provided herein is a self-adjusting wrench comprising a fixed jaw member having a distal end extending from a wrench housing, the housing defines: a channel configured to receive a handle, a chamber configured to receive at least a portion of a movable jaw member, an immobilizing boss disposed within the channel, a biasing member boss, and a biasing member tab; a movable jaw member having a distal end and a proximal end, the proximal end slidably operably coupled to the fixed jaw member's housing; an elongated handle operably coupled to the wrench housing, the handle having a proximal end and a distal end, and is capable of sliding toward and away from the fixed jaw, wherein the handle's distal end comprises an anterior wedge having a generally triangular shape with the base of the triangle of the anterior wedge closer to the terminal distal end of the handle and an oppositely configured posterior wedge; a two-dimensional biasing member, the biasing member being operably coupled to the distal end of the movable jaw member portion disposed within the fixed jaw member housing, and with the distal end of the handle, the biasing member capable of simultaneously biasing the movable jaw toward the fixed jaw and the handle away from the fixed jaw; and a housing cover, wherein the proximal end of the movable jaw member comprising the wrench housing is configured to engage the distal end of the handle and lock the gap between the fixed jaw and movable jaw.

In an embodiment, the term "proximal" provides an initial reference point and the term "distal" means more distant from the initial reference point along a generally vertical axis. The term "anterior" means toward the front part or the face and the term "posterior" means toward the back of the member.

The immobilizer boss can be medially (in other words, towards the midline) disposed within an immobilizing channel formed within the wrench housing, having an open proximal end configured to receive the handle. The channel also has a distal end, terminating in a slot that is substantially narrower than the channel and can be configured to receive the posterior wedge and limit the motion of the handle. The term "wedge" used in connection with the projection formed on the outer surface of the handle means ones which function as a wedge when fitted into a space formed on a fixed member such as the immobilizing slot and refers generally also to a wedge-shaped protrusion or "boss". "Wedge-shaped" is intended to include cases where the top and bottom faces are non-planar, e.g. these surfaces can be convex, concave or chamfered. The edge formed by the wedge also need not be straight or sharp, e.g. it can be curved, rounded or chamfered. "Wedge-shaped" refers to the wedge-end of the push-block. The back-end need not be flat, e.g. it can be chamfered or rounded. By this definition, a hydrofoil shape qualifies as being wedge-shaped.

The distal end of the fixed jaw member can have an external blunt surface and an internal serrated surface (in other words, having a boundary line that is notched or jagged). The external blunt surface could be shaped in any shape such as an arcuate shape and can be applied to any arrangement that selectively permits the reception and retention of an object. Similarly, the distal end of the movable jaw member has an external blunt surface and an internal serrated surface configured to mesh with the serrated surface of the fixed jaw member. Generally, the movable jaw portion of the movable member can be a mirror image of the jaw portion of the fixed jaw member. However, in certain embodiment, the jaws will not mesh, nor will the surfaces form a continuum in the free position. In addition, the distal end of the movable jaw member and the distal end of the fixed jaw member can terminate with a slope declining toward the contact point between the fixed jaw and the movable jaw. In other words, the slopes incline toward each other, creating a V shape contact surface and are configured to provide a gap for receiving the nut, bolt or another elongated member sought to be adjusted when pressure is applied with the handle against the elongated member. The slope does not need to be a straight line and can be convex or concave, so long as it creates the appropriate mating surface for an object sought to be manipulated by the wrench.

The proximal end of the movable jaw member can define a substantially rectangular tray shape with a frame having two shorter vertical side walls, with a longer horizontal top wall, above which the movable jaw portion is coupled and which forms the distal end of the movable jaw member. Accordingly, the top wall of the tray can form a surface that slide along the top wall of the wrench housing. Also present is a horizontal bottom wall, or floor, wherein the horizontal bottom wall can be protrusions defining a jigsaw shape mating surface (in other words, jigsaw-shaped mating surface arranged in a zigzag pattern), the jigsaw shape mating surface forming angled slots that, as indicated above, can be configured to engage the anterior wedge of the handle.

The distal end of the handle, which can be substantially elongated defining a longitudinal axis that is substantially longer than the perpendicular axis at any given point along the handle and which can be used in the self-adjusting wrenches described herein, can define therein a longitudinally axially oriented oval opening, configured to receive the immobilizing boss disposed in the immobilizing channel and limit movement of the handle to the length of the opening defined within the handle.

The biasing member can comprise two portions; a biasing portion that exerts an increased biasing force as its length is increased or extended (e.g. an extension portion), and a portion which sets the threshold setting for actuation loads that place the handle locking tension (e.g., tension portion). The tension portion can be in the form of a resilient swing arm coupled to the wrench housing. The extension portion can operably couple the movable jaw member to the fixed jaw member, for example by being attached to the biaser boss attached to the side wall of the proximal end of the movable jaw member, disposed to one side of the frame formed by the two vertical side walls and the top and bottom walls. In the fixed jaw member, the extension portion of the biasing member can be anchored on the anchor boss. The tension portion of the biasing member, for example a resilient swing arm, can be anchored on one side by, for example, a tab disposed on the wall of the wrench housing and be operably coupled to the terminal end of the handle's distal end. The tension portion can be configured to be operably coupled to the handle in a groove configured to slidably receive the tension portion of the biasing member.

The portions forming the biasing member, in other words, the extension portion and the tension portion, can have the same or different thickness, and can be for example, 0.3 to 3.0 mm, or 0.5 to 2.5 mm. Specifically, the thickness of either or both the extension portion or tension portion of the biasing member can be between about 1.0 mm to about 2.0 mm.

The self-adjusting wrench may be formed using metallic, or nonmetallic material. The nonmetallic material can be, for example, carbon fibers or glass fibers. Metallic materials can be iron materials and alloys or non-iron materials. The non-iron material can be, for example, aluminum alloy or zinc alloy. Methods for forming the wrench can be, for example hot gorging, annealing, casting, sand spraying, machining, heat treatment, grinding and polishing.

In addition, in certain embodiment, the wrench or its components can be made of thermoplastic materials, further comprising reinforced fibers, such as, for example, glass fiber. Exemplary thermoplastics include polycarbonate, polybutylene terephalate, polypropylene, acrylonitrile-butadiene-styrene (ABS), acrylic-styrene-acrylonitrile (ASA), polyester (e.g., PBT, PET), polyamides, polyethylene (e.g., low density polyethylene (LDPE), high density polyethylene (HDPE)), polyamides, phenylene sulfide resins, polyvinyl chloride (PVC), polystyrene (e.g., high impact polystyrene (HIPS)), polypropylene (PP), polyphenylene ether resins, and thermoplastic olefins (TPO), and combinations comprising at least one of the foregoing. Some additional examples of plastic materials that can be used for the springs include, but are not limited to, polycarbonate/ABS blends, a copolycarbonate-polyester, acrylonitrile-(ethylene-polypropylene diamine modified)-styrene (AES), polyphenylene oxide and polystyrene (e.g., glass filled blends of polyphenylene oxide and polystyrene), blends of polyphenylene ether/polyamide, blends of polycarbonate/polyethylene terephthalate (PET)/polybutylene terephthalate (PBT), blends of polycarbonate/polybutylene terephthalate, polyethylene and fiber composites, polypropylene and fiber composites, long fiber reinforced thermoplastics, and combinations comprising at least one of the foregoing plastic materials. Commercially available materials include LEXAN™ resins, LEXAN™ resins, XENOY™ resins, NORYL GTX™. resins, NORYL™ resins, and VERTON™ resins.

Also provided herein are methods of using the self-adjusting wrench described herein. Accordingly and in one embodiment, provided herein is a method of turning a threaded rotating member (e.g., a nut, a bolt, a screw, a rod, or a rotating member comprising at least one of the foregoing), comprising: using the handle, pressing a self-adjusting wrench against the rotating member, the self-adjusting wrench comprising a fixed jaw having a distal end extending from a wrench housing, the housing defines a channel configured to receive a handle, a chamber configured to receive a portion of a movable jaw, an immobilizing boss, a biasing member boss, and a biasing member tab; a movable jaw having a distal end and a proximal end, the proximal end slidably operably coupled to the fixed jaw housing; an elongated handle operably coupled to the wrench housing, the handle having a proximal end and a distal end, and is capable of sliding toward and away from the fixed jaw, wherein the handle's distal end comprises an anterior wedge and an opposite posterior wedge; a two-dimensional biasing member, operably coupled to the distal end of the movable jaw, the wrench housing and the distal end of the handle, capable of simultaneously biasing the movable jaw toward the fixed jaw and the handle away from the fixed jaw; and a housing cover, wherein the proximal end of the movable jaw is configured to engage the distal end of the handle and lock the gap between the fixed jaw and movable jaw; adjusting the gap between the fixed jaw and the movable jaw member; and applying torque effective to rotate the member.

In the methods using the wrench described herein, the handle is used to apply force to the sloped end of the jaws against the threaded object, causing the distal end of the handle, abutting the tension portion of the biasing member to slide along the channel defined within the handle and overcome the threshold tension force exerted by the tension portion of the biasing member, separate the anterior wedge from the jigsaw-shaped mating surface and unlocking the movable and fixed jaw members, allowing them to separate against the force exerted by the extension portion of the biasing member. Once the jaws separate to the gap corresponding to the radial width of the rotating member sought to be turned, the force on the tension biasing portion of the biasing member will decrease to below the threshold level and push the handle away from the jaws, causing the anterior wedge at the distal end of the to engage the jigsaw-shaped mating surface of the proximal end of the movable jaw member, locking the gap in place. Since the jigsaw-shaped mating surface is slanted in the direction of the movable jaw member, (see e.g., FIG. 4A), upon pulling the jaws away from the rotating object, the extension portion of the biasing member will cause the jaws to return to the relaxed state where the jaws are at the minimum gap.

Detailed embodiments of the present technology are disclosed herein; however, it is to be understood that the disclosed embodiments are merely exemplary, which can be embodied in various forms. Therefore, specific structural and functional details disclosed herein are not to be interpreted as limiting but merely as a basis for the claims and as a representative basis for teaching one skilled in the art to variously employ the present invention in virtually any appropriately detailed structure. Further, the terms and phrases used herein are not intended to be limiting but rather to provide an understandable description of the invention.

The terms "first," "second," and the like, herein do not denote any order, quantity, or importance, but rather are used to denote one element from another. The terms "a", "an" and "the" herein do not denote a limitation of quantity, and are to be construed to cover both the singular and the plural, unless otherwise indicated herein or clearly contradicted by context. The suffix "(s)" as used herein is intended to include both the singular and the plural of the term that it modifies, thereby including one or more of that term (e.g., the film(s) includes one or more films). Reference throughout the specification to "one embodiment", "another embodiment", "an embodiment", and so forth, means that a particular element (e.g., feature, structure, and/or characteristic) described in connection with the embodiment is included in at least one embodiment described herein, and may or may not be present in other embodiments. In addition, it is to be understood that the described elements may be combined in any suitable manner in the various embodiments.

In addition, for the purposes of the present disclosure, directional or positional terms such as "top", "bottom", "upper," "lower," "side," "front," "frontal," "forward," "rear," "rearward," "back," "trailing," "above," "below," "left," "right," "horizontal," "vertical," "upward," "downward," "outer," "inner," "exterior," "interior," "intermediate," etc., are merely used for convenience in describing the various embodiments of the present disclosure.

The term "coupled", including its various forms such as "operably coupled", "coupling" or "coupleable", refers to and comprises any direct or indirect, structural coupling, connection or attachment, or adaptation or capability for such a direct or indirect structural or operational coupling, connection or attachment, including integrally formed components and components which are coupled via or through another component or by the forming process. Indirect coupling may involve coupling through an intermediary member or adhesive, or abutting and otherwise resting against, whether frictionally or by separate means without any physical connection.

The term "boss" generally refers to protuberance on a part designed to add strength, facilitate alignment, provide fastening, etc. Exemplary boss elements include shapes such as a tab, detent, flange etc.

The term "engage" and various forms thereof, when used with reference to retention of a member, refer to the application of any forces that tend to hold two components together against inadvertent or undesired separating forces (e.g., such as may be introduced during use of either component). It is to be understood, however, that engagement does not in all cases require an interlocking connection that is maintained against every conceivable type or magnitude of separating force. Also, "engaging element" or "engaging member" refers to one or a plurality of coupled components, at least one of which is configured for releasably engaging a locking pin.

A more complete understanding of the components, processes, assemblies, and devices disclosed herein can be obtained by reference to the accompanying drawings. These figures (also referred to herein as "FIG.") are merely schematic representations (e.g., illustrations) based on convenience and the ease of demonstrating the present disclosure, and are, therefore, not intended to indicate relative size and dimensions of the devices or components thereof and/or to define or limit the scope of the exemplary embodiments. Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

FIG. 1, illustrates an embodiment of the self-adjusting wrench 10 in its assembled state, showing distal end of movable jaw member 30, distal end of fixed jaw member 20, and proximal end of handle 40. As shown, wrench housing cover 25 can be coupled to the wrench housing 28 (not shown) using fixing means, for example, screws.

Turning now to FIGS. 2-4, showing (in FIG. 2A) front view of fixed jaw member with distal end 20 comprising the grip jaw with slope $\mathbf{20}_S$ disposed to one side extending from wrench housing 28. Wrench housing 28, defines channel 22, configured to receive proximal end of movable jaw member 35 (FIG. 4A) and which has biasing member tab 222 and biasing member anchor 221 configured to be coupled to biasing member 50 (not shown). Wrench housing 28, also defines immobilizing channel 23, which is open at the proximal end of wrench housing 28 and is configured to receive the distal end of handle 40 (not shown). Immobilizing channel 23 terminates with slot 231 configured to receive posterior wedge 41 (not shown, see e.g., FIG. 5A). Immobilizing boss 29 is disposed within channel 23 along the midline of the channel. As shown in the side view of fixed jaw member 20 (FIG. 2B), channel 22 can comprise a groove 201 spanning the width of channel 23, which, in combination with wrench housing cover 25, is configured to form a track along which shelf portion 39 (FIG. 4D) and the resulting groove 353, the proximal end 35 of the movable jaw member can slide. Serrated portion 21 of the distal end 20 of the fixed jaw member, can be configured to be complementary to, and mesh with serrated portion 31 (see e.g., FIG. 4B) of the distal end 30 of the movable jaw member.

Turning now to FIG. 3, showing a side view in FIG. 3A of the cover to wrench housing 28, and a front view in FIG. 3B. As shown, wrench house cover 25 comprises a circular lip 251, configured to partially enclose immobilizing boss 29 when wrench housing cover 25 is coupled to wrench housing 28 with, for example, fastening means 253 (FIG. 3B). Also shown is tab 252, configured to, together with groove 201, to form the track along which shelf portion 39 (FIG. 4D) and the resulting grove 353, of the proximal end 35 of the movable jaw member can slide.

FIG. 4 shows in greater detail, the movable jaw member with distal jaw end 30 configured to be instrumental in grasping objects when, for example, the contact surface with the objects, can be serrated 31 (FIG. 4A). As shown in FIG. 4A, the movable jaw member comprises distal end with the operative jaw 30, comprising serrations 31, disposed over the proximal end 35, defining a substantially rectangular tray having a frame comprising two shorter vertical walls, a longer horizontal top wall forming shelf 39, above which distal end with the operative jaw 30, comprising serrations 31, and bottom surface 352 is disposed and a longer horizontal bottom wall, or floor, upon which protrusions defining a jigsaw-shaped mating surface 32 (in other words, jigsaw-shaped mating surface arranged in a zig-zag pattern) can be disposed, with teeth having slopes therebetween that incline away from the distal end of the fixed jaw member. Also shown in FIGS. 4A and 4C, is biasing member boss 351, configured to couple to biasing member 50 (not shown) and a side wall covering the frame to one side, creating the tray shape of proximal end 35. Further details of the terminal end of distal end 30 are shown in FIG. 4B, showing slope $\mathbf{30}_S$, configured to abut the object sought to be turned using self-adjusting wrench 10, as well as tooth 33 protruding beyond serrations 31, configured to assist in engaging the object sought to be turned, by, for example, preventing the object from sliding out of the grasp of the jaws. FIG. 4C, shows an isometric perspective of the movable jaw member with distal end jaw 30 extending above proximal end 35, defining the tray showing shelf 39 (see e.g., FIG. 4D) and the resulting tracks, which, in combination with the top surface 352 create groove 353, configured to receive tab 252 (FIG. 3A) when wrench housing cover 25 is coupled to wrench housing 28. FIG. 4D illustrates, that groove 353 formed by shelf 39 extends around both front and back of the proximal end 35 of the movable jaw member.

Figure 5B:
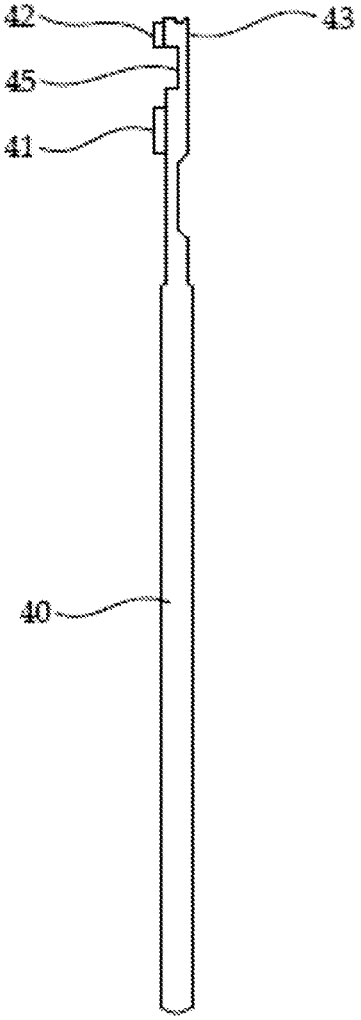

Turning now to FIG. 5, showing handle 40 front view in FIG. 5A and side view in FIG. 5B. As shown, Handle 40 comprises oppositely disposed posterior 41 and anterior 42 wedge-shaped protrusions. As illustrated, and is not intended to be limiting, posterior immobilizing wedge 41 is longer than anterior immobilizing wedge 42, configured to engage jigsaw-shaped mating surface 32 (see e.g., FIG. 4A), while posterior immobilizing wedge is configured to slide into slot 231 in the terminal end of channel 23 defined in wrench housing 28. Also shown in FIG. 5A, is elongated oval opening 44 defined by the distal end of handle 40, configured to slidably couple to wrench housing 28 and receive immobilizing boss 29 (FIG. 2A). FIG. 5B shows a side view of handle 40, illustrating posterior immobilizing wedge 41 protruding from handle 40 with depression 45, configured to receive jigsaw-shaped mating surface and allow anterior immobilizing wedge 42 disengage from jigsaw-shaped mating surface 32. Also shown in FIG. 5B, is groove 43, configured to receive and abut a portion biasing member 50 (not shown).

Figure 6:
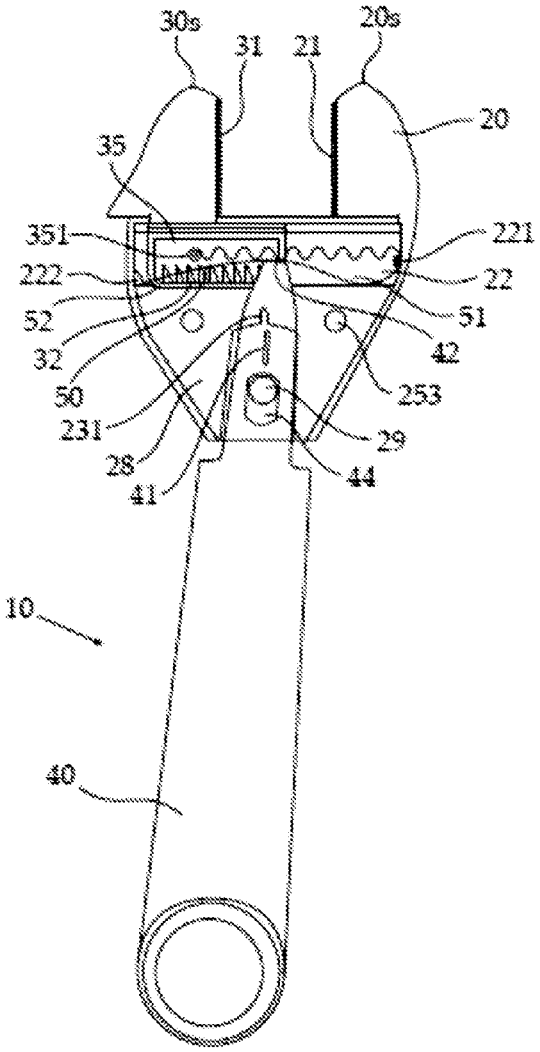
FIG. 6, shows an embodiment of the self-adjusting wrench of claim 1 without the wrench housing cover.
Figure 7:
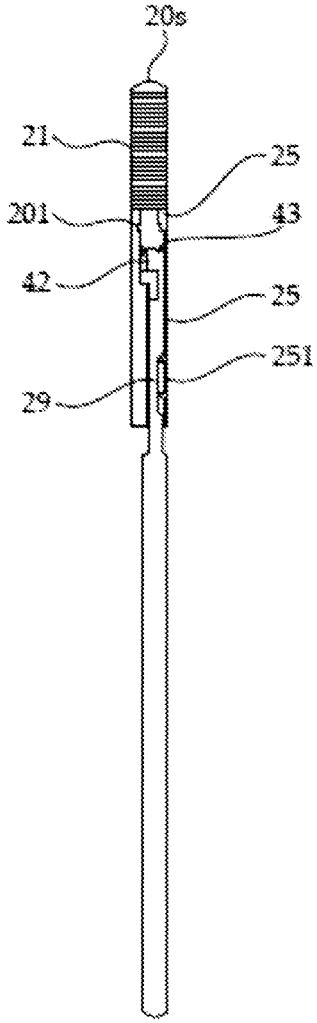
FIG. 7, shows a side view of the handle coupled to the fixed jaw member.

Turning now to FIGS. 6 and 7, showing self-adjusting wrench 10, assembled without wrench housing cover 25 in FIG. 6, and fixed jaw member with only handle 40 and without the movable jaw member in FIG. 7. FIG. 6 shows self-adjusting wrench 10 in its open position, such that when using the handle 40, pressing a self-adjusting wrench 10 against a rotating member, the self-adjusting wrench 10 comprising a fixed jaw having a distal end 20 extending from a wrench housing 28, the housing defines a channel 23 configured to receive handle 40, chamber 22 configured to receive a portion of a movable jaw (e.g., distal end 35 of movable jaw member), an immobilizing boss 29, a biasing member boss 221, and a biasing member tab 222. Movable jaw member is shown having a distal end 30 and a proximal end 35, the proximal end 35 slidably operably coupled to the fixed jaw housing 28. Elongated handle 40 can be operably coupled to the wrench housing 28, where handle 40 is illustrated having a proximal end and a distal end, defining oval opening 44, and is capable of sliding toward and away from the fixed jaw in channel 23 which is open in one end, wherein the handle's distal end comprises an anterior immobilizing wedge 42 configured to engage jigsaw-shaped mating surface 32 disposed on proximal end 35 of the movable jaw member and an oppositely disposed posterior immobilizing wedge 41, configured to slide within channel 23 and enter slot 231. Two-dimensional biasing member 50 is shown, operably coupled to the distal end of the movable jaw 35 via, for example, biasing member boss 351, to wrench housing 28 via biasing member 221 and biasing member tab 222, and to the distal end of handle 40 engaging groove 43 in handle 40, capable of simultaneously biasing the movable jaw member and distal end 30 toward the fixed jaw member and distal end 20, and handle 40 away from the fixed jaw member 20, such that proximal end 35 of the movable jaw member is configured to engage the distal end of handle 40 and lock the gap between the fixed jaw and movable jaw. As shown in FIG. 7, covering wrench housing 28, with cover 25, comprising circular lips 251 partially cover immobilizing boss 29 and lip 252, which, together with groove 201 form the track for slidably coupling the movable jaw member (not shown)

Figure 8:
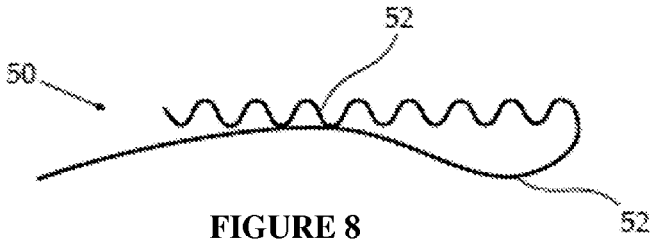
FIG. 8, shows an embodiment of the biasing member.

Turning now to FIG. 8, showing biasing member 50 comprising tension portion 51 and extension portion 52.

In an embodiment, provided herein is a self-adjusting wrench comprising a fixed jaw member having a distal end extending from a wrench housing, the housing defines: a channel configured to receive a handle, a chamber configured to receive a portion of a movable jaw member, an immobilizing boss, a biasing member boss, and a biasing member tab; a movable jaw member having a distal end and a proximal end, the proximal end slidably operably coupled to the fixed jaw's wrench housing; an elongated handle operably coupled to the wrench housing, the handle having a proximal end and a distal end, and is capable of sliding toward and away from the fixed jaw, wherein the handle's distal end comprises an anterior wedge and an opposite posterior wedge; a two-dimensional biasing member, operably coupled to the proximal end of the movable jaw member, the wrench housing and the distal end of the handle, capable of simultaneously biasing the movable jaw member toward the fixed jaw member and the handle away from the fixed jaw; and a housing cover, wherein the proximal end of the movable jaw member is configured to engage the distal end of the handle and lock the gap between the fixed jaw and movable jaw, wherein (i) the immobilizer boss is disposed within an immobilizing channel having an open proximal end and a distal end, terminating in a slot configured to receive the posterior wedge and limit the motion of the handle, (ii) the distal end of the fixed jaw has an external blunt surface and an internal serrated surface, (iii) wherein the distal end of the movable jaw has an external blunt surface and an internal serrated surface configured to mesh with the serrated surface of the fixed jaw, (iv) the distal end of the handle defines therein an axially oriented oval opening, configured to receive the immobilizing boss and limit movement of the handle to the length of the opening, (v) the proximal end of the movable jaw defines a rectangular tray defining a frame having two shorter vertical side walls a longer horizontal top wall, and a longer horizontal bottom wall, wherein the horizontal bottom wall has jigsaw jigsaw-shaped mating surface disposed thereon, the jigsaw-shaped mating surface configured to engage the anterior wedge of the handle, wherein (vi) the two-dimensional biasing member comprises an extension which, (vii) operably couples the movable jaw and fixed jaw and a tension portion, which (viii) is operably coupled to the distal end of the handle, wherein (ix) the thickness of the tension portion is the same as, or (x) different than the thickness of the extension portion, wherein the thickness of the tension portion, or (xi) the extension portion is between 0.3 to 3.0 mm, wherein (xii) the distal end of the movable jaw member and the distal end of the fixed jaw terminate with a slope declining toward the contact point between the fixed jaw and the distal end of the movable jaw member, creating a V shape contact surface.

In yet another embodiment, provided herein is a method of turning a threaded rotating member for example, (xiii) a nut, a bolt, a screw, a rod, or a rotating member comprising at least one of the foregoing, comprising: using the handle, pressing a self-adjusting wrench against the rotating member, the self-adjusting wrench comprising a fixed jaw having a distal end extending from a wrench housing, the housing defines a channel configured to receive a handle, a chamber configured to receive a portion of a movable jaw, an immobilizing boss, a biasing member boss, and a biasing member tab; a movable jaw member having a distal end and a proximal end, the proximal end slidably operably coupled to the fixed jaw wrench housing; an elongated handle operably coupled to the wrench housing, the handle having a proximal end and a distal end, and is capable of sliding toward and away from the fixed jaw, wherein the handle's distal end comprises an anterior wedge and an opposite posterior wedge; a two-dimensional biasing member, operably coupled to the distal end of the movable jaw member, the wrench housing and the distal end of the handle, capable of simultaneously biasing the movable jaw member toward the fixed jaw and the handle away from the fixed jaw; and a housing cover, wherein the proximal end of the movable jaw member is configured to engage the distal end of the handle and lock the gap between the fixed jaw and movable jaw; adjusting the gap between the fixed jaw and the movable jaw member; and applying torque effective to rotate the member, wherein (xiv) the two-dimensional biasing member comprises an extension portion and a tension portion, (xv) the distal end of the handle defines therein an axially oriented oval opening, configured to receive the immobilizing boss and limit movement of the handle to the length of the opening, (xvi) the extension portion of the biasing member operably couples the movable jaw member and fixed jaw, and the tension portion is operably coupled to the distal end of the handle, (xvii) and the distal end of the movable jaw member and the distal end of the fixed jaw terminate with a slope declining toward the contact point between the fixed jaw and the movable jaw when the fixed jaw contacts the movable jaw, creating a V shape contact surface.

While in the foregoing specification the self-adjusting wrench has been described in relation to certain embodiments, and many details are set forth for purpose of illustration, it will be apparent to those skilled in the art that the disclosure of the self-adjusting wrench is susceptible to additional embodiments and that certain of the details described in this specification and as are more fully delineated in the following claims can be varied considerably without departing from the basic principles of this invention.

We claim:

1. A self-adjustable wrench comprising:

a fixed jaw member having a distal end and a proximal end fixed to and extending from a wrench housing, the housing defines a channel configured to receive a handle, and a chamber configured to receive a portion of a movable jaw member;

a movable jaw member having a distal end and a proximal end, the proximal end slidably operably coupled to the fixed jaw wrench housing;

an elongated handle operably coupled to the wrench housing, the handle having a proximal end and a distal end, and is capable of sliding toward and away from the fixed jaw, wherein the handle's distal end comprises an anterior wedge and an opposite posterior wedge;

a two dimensional biasing member, operably coupled to the proximal end of the movable jaw member, the wrench housing and the distal end of the handle, capable of simultaneously biasing the movable jaw member toward the fixed jaw and the handle away from the fixed jaw; and a wrench housing cover, wherein the proximal end of the movable jaw member is configured to engage the distal end of the handle to lock the gap between the fixed jaw and movable jaw member.

2. The self-adjustable wrench of claim 1, wherein an immobilizer boss is disposed within the channel defined within the wrench housing, having an open proximal end and a distal end, terminating in a slot configured to receive the posterior wedge and limit the motion of the handle.

3. The self-adjustable wrench of claim 1, wherein the distal end of the fixed jaw has an external blunt surface and an internal serrated surface.

4. The self-adjustable wrench of claim 3, wherein the distal end of the movable jaw member has an external blunt surface and an internal serrated surface configured to mesh with the serrated surface of the fixed jaw.

5. The self-adjustable wrench of claim 2, wherein the distal end of the handle defines therein an axially oriented oval opening, configured to receive the immobilizing boss and limit movement of the handle to the length of the opening.

6. The self-adjustable wrench of claim 1, wherein the proximal end of the movable jaw member defines a rectangular tray having a frame with two shorter vertical side walls, a longer horizontal top wall, and a longer horizontal bottom wall, wherein the horizontal bottom wall has jigsaw-shaped mating surface disposed thereon, the jigsaw-shaped mating surface configured to engage the anterior wedge of the handle.

7. The self-adjustable wrench of claim 6, wherein the two-dimensional biasing member comprises an extension portion and a tension portion.

8. The self-adjustable wrench of claim 7, wherein the extension portion operably couples the movable jaw member and the fixed jaw.

9. The self-adjustable wrench of claim 7, wherein the tension portion is operably coupled to the distal end of the handle.

10. The self-adjustable wrench of claim 7, wherein the thickness of the tension portion is the same as the thickness of the extension portion.

11. The self-adjustable wrench of claim 7, wherein the thickness of the tension portion is different than the thickness of the extension portion.

12. The self-adjustable wrench of claim 7, wherein the thickness of the tension portion is between 0.3 to 3.0 mm.

13. The self-adjustable wrench of claim 7, wherein the thickness of the extension portion is between 0.3 to 3.0 mm.

14. The self-adjusting wrench of claim 1, wherein the distal end of the movable jaw and the distal end of the fixed jaw terminate with a slope declining toward the contact point between a fixed jaw and the movable jaw when the jaws are closed such that the fixed jaw contacts the movable jaw.

15. A method of turning a threaded rotating member, comprising:

using a handle, pressing a self-adjusting wrench against the rotating member, the self-adjusting wrench comprising a fixed jaw having a distal end and a proximal end fixed to and extending from a wrench housing, the housing defines a channel configured to receive a handle, a chamber configured to receive a portion of a movable jaw member, an immobilizing boss, a biasing member boss, and a biasing member tab; a movable jaw member having a distal end and a proximal end, the proximal end slidably operably coupled to the fixed jaw wrench housing; an elongated handle operably coupled to the wrench housing, the handle having a proximal end and a distal end, and is capable of sliding toward and away from the fixed jaw within the wrench housing channel, wherein the handle's distal end comprises an anterior wedge and an opposite posterior wedge; a two-dimensional biasing member, operably coupled to the distal end of the movable jaw, the wrench housing and the distal end of the handle, capable of simultaneously biasing the movable jaw toward the fixed jaw and the handle away from the fixed jaw; and a housing cover, wherein the proximal end of the movable jaw is configured to engage the distal end of the handle to lock the gap between the fixed jaw and movable jaw;

adjusting the gap between the fixed jaw and the movable jaw member; and applying torque effective to rotate the member.

16. The method of claim 15, wherein the threaded rotating member is a nut, a bolt, a screw, a rod, or a rotating member comprising at least one of the foregoing.

17. The method of claim 15, wherein the two-dimensional biasing member comprises an extension portion and a tension portion.

18. The method of claim 15, wherein the distal end of the handle defines therein an axially oriented oval opening, configured to receive the immobilizing boss and limit movement of the handle to the length of the opening.

19. The method of claim 17, wherein the extension portion operably couples the movable jaw and fixed jaw, and the tension portion is operably coupled to the distal end of the handle.

20. The method of claim 15, wherein the distal end of the movable jaw member and the distal end of the fixed jaw terminate with a slope declining toward a contact point between the fixed jaw and the movable jaw when the jaws are closed such that the fixed jaw contacts the movable jaw.

* * * * *